US010786094B2

(12) United States Patent
Bruegmann

(10) Patent No.: US 10,786,094 B2
(45) Date of Patent: Sep. 29, 2020

(54) MERCHANDISE DISPLAY DEVICE

(71) Applicant: Bruegmann GmbH & Co. KG, Hagen (DE)

(72) Inventor: Lars Bruegmann, Dortmund (DE)

(73) Assignee: Bruegmann GmbH & Co. KG, Hagen (DE)

( * ) Notice: Subject to any disclaimer, the term of this patent is extended or adjusted under 35 U.S.C. 154(b) by 0 days.

(21) Appl. No.: 16/520,164

(22) Filed: Jul. 23, 2019

(65) Prior Publication Data

US 2020/0093282 A1 Mar. 26, 2020

(30) Foreign Application Priority Data

Sep. 21, 2018 (DE) ..... 10 2018 123 288

(51) Int. Cl.
*A47F 1/12* (2006.01)
*A47F 5/00* (2006.01)

(52) U.S. Cl.
CPC ..... *A47F 1/126* (2013.01); *A47F 5/005* (2013.01)

(58) Field of Classification Search
CPC ..... A47F 1/125; A47F 1/126; A47F 1/128
See application file for complete search history.

(56) References Cited

U.S. PATENT DOCUMENTS 5,366,099 A * 11/1994 Schmid ..... A47F 1/126 211/175
5,855,283 A * 1/1999 Johnson ..... A47F 1/126 211/103
6,464,089 B1 * 10/2002 Rankin, VI ..... A47F 1/126 211/59.3
6,866,156 B2 * 3/2005 Nagel ..... A47F 1/126 211/59.3
6,886,699 B2 * 5/2005 Johnson ..... A47F 1/126 108/61
7,458,473 B1 * 12/2008 Mason ..... A47F 1/126 211/175

(Continued)

FOREIGN PATENT DOCUMENTS

DE 202016000634 U1 3/2016
DE 202016104354 U1 8/2016
EP 2773242 B1 4/2017

*Primary Examiner* — Stanton L Krycinski
(74) *Attorney, Agent, or Firm* — Medley, Behrens & Lewis, LLC

(57) ABSTRACT

The present invention relates to a merchandise display device for displaying goods on a goods conveyor, including:

Figure 1A:
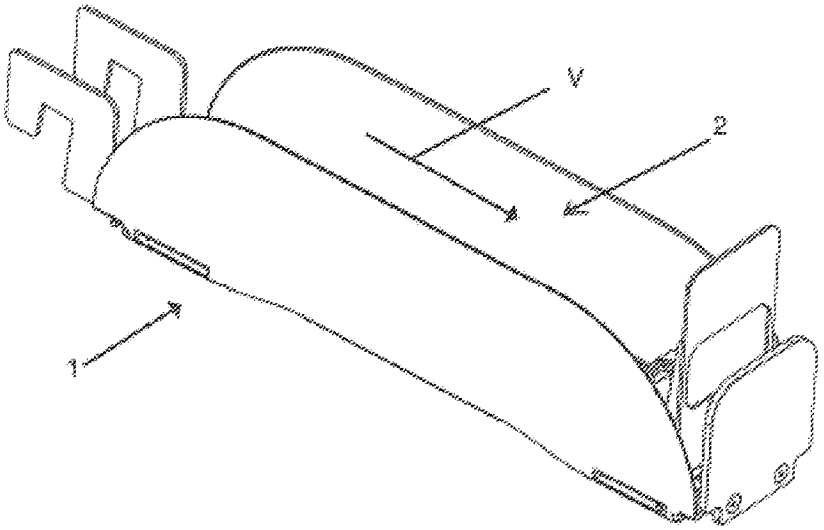

- a goods tray for supporting the goods along a feed direction V from a rear end to a front end of the goods tray,
- a front fixing element attached to the front end,
- a rear fixing element attached to the rear end,
- two struts supporting the goods tray on the rear fixing element, each having a hook section for fastening the struts to a bracket,
- a goods end stop arranged on the front fixing element,
- a pusher device which is guided along the goods tray to advance the goods in feed direction V,
- at least one, preferably two divider walls which delimit the goods conveyor laterally and is/are constructed to be displaceable for adjusting a width of the goods conveyor transversely to the feed direction V, wherein the goods tray is constructed at least mostly, preferably practically entirely as a closed surface between the struts.

20 Claims, 2 Drawing Sheets

(56) References Cited

U.S. PATENT DOCUMENTS

| | | | | |
|---|---|---|---|---|
| 7,681,744 | B2 * | 3/2010 | Johnson | A47F 1/126 211/59.3 |
| 7,823,734 | B2 * | 11/2010 | Hardy | A47F 1/126 211/59.3 |
| 8,210,367 | B2 * | 7/2012 | Nagel | A47F 1/125 211/126.16 |
| 8,453,851 | B2 * | 6/2013 | Ciesick | A47F 1/04 211/126.15 |
| 8,720,702 | B2 * | 5/2014 | Nagel | A47B 96/027 211/59.3 |
| 8,812,378 | B2 * | 8/2014 | Swafford, Jr. | A47F 1/126 705/28 |
| 8,910,801 | B2 * | 12/2014 | Johnson | A47F 1/126 211/59.3 |
| 9,016,484 | B2 * | 4/2015 | Kologe | A47F 1/125 211/59.3 |
| 9,101,230 | B2 * | 8/2015 | Sosso | A47F 1/125 |
| 9,129,494 | B2 * | 9/2015 | Valiulis | G08B 13/14 |
| 9,138,076 | B2 * | 9/2015 | Hardy | A47F 1/126 |
| 9,167,914 | B2 * | 10/2015 | Rankin, VI | A47F 1/126 |
| 9,254,049 | B2 * | 2/2016 | Nagel | A47F 1/04 |
| 9,392,883 | B2 * | 7/2016 | Kologe | A47F 1/125 |
| 9,629,480 | B2 * | 4/2017 | Ewing | A47F 1/126 |
| 9,713,394 | B1 | 7/2017 | Bruegmann | |
| 9,986,852 | B2 * | 6/2018 | Chenoweth | A47F 3/001 |
| 10,034,557 | B1 * | 7/2018 | Nagel | A47F 5/005 |
| 10,165,871 | B2 | 1/2019 | Hardy | |
| 10,251,494 | B1 * | 4/2019 | Nagel | A47F 5/005 |
| 2005/0168345 | A1 * | 8/2005 | Swafford, Jr. | A47F 1/126 340/686.1 |
| 2006/0186065 | A1 | 8/2006 | Ciesick | |
| 2011/0215060 | A1 * | 9/2011 | Niederhuefner | G08B 13/14 211/59.3 |
| 2015/0230628 | A1 * | 8/2015 | Juric | A47F 5/005 211/59.2 |
| 2017/0202369 | A1 * | 7/2017 | Mercier | A47F 1/126 |
| 2017/0273477 | A1 * | 9/2017 | Mercier | A47F 1/126 |
| 2018/0103774 | A1 | 4/2018 | Chenoweth et al. | |
| 2019/0279149 | A1 * | 9/2019 | Swafford | A47F 1/126 |

* cited by examiner

MERCHANDISE DISPLAY DEVICE

The present invention relates to a merchandise display device according to Claim 1 for displaying goods on a goods conveyor.

Merchandise shelves with self-adjusting merchandise display devices are known in the related art, wherein reference is made in particular to EP 2 773 242 B1, which relates to a goods pusher shelf with a basic construction that has a pair of load-bearing elements which support a product tray formed by elongated, horizontal rods.

Typically on such merchandise display devices, a number of products are positioned one behind the other along the goods tray. In the shop salesroom, the front item in each case is then taken from the goods tray by a customer. As soon as an item has been removed, the remaining items are automatically propelled towards a front side in a feed direction V along a goods conveyor by a pusher device until the leading item bears on an end stop.

Based on the abovementioned related art, the task underlying the invention is to describe an improved, simply manageable merchandise display device, with which in particular an improved cooling and/or simpler assembly is enabled, particularly due to the existence of fewer components.

The task is solved with the features of Claim 1. Further advantageous features of the invention are described in the subclaims. The scope of the invention extends to all combinations of at least two of the features disclosed in the description, the claims and/or the figures.

The merchandise display device according to the invention has the following features:

- a goods tray for supporting the goods along a feed direction V from a rear end to a front end of the goods tray,
- a front fixing element attached to the front end,
- a rear fixing element attached to the rear end,
- two struts supporting the goods tray on the rear fixing element, each having a hook section for fastening the struts to a bracket,
- a goods end stop arranged on the front fixing element,
- a pusher device which is guided along the goods tray to advance the goods in feed direction V,
- at least one, preferably two, divider wall which delimits the goods conveyor laterally and is constructed to be displaceable for adjusting a width of the goods conveyor transversely to the feed direction V, wherein the goods tray is constructed at least mostly, preferably practically entirely as a closed surface between the struts.

Practically entirely means that, apart from liquid drainage apertures provided in particular advantageously, the goods tray has a completely closed surface.

Not only does the design according to the invention improve the complexity of the construction of the merchandise display device, but it also prevents objects from falling through, and it improves cooling particularly when a closed surface made from material with high thermal conductivity (particularly metals), preferably a metallic material is provided.

Correspondingly preferred is an advantageous further development of the invention, according to which the goods tray is made from particularly rolled or extruded metal sheet, preferably aluminum. In this way, the cooling effect within a shelf formed by the merchandise display device according to the invention, particularly floating shelves. At the same time, the merchandise display device has a more striking appearance, particularly when the goods conveyors are empty. The goods tray is preferably manufactured by extruding aluminum.

In a further development of the invention, it is provided with advantage that the goods tray has at least one corrugation which extends particularly continuously from the front end to the rear end in feed direction V. The corrugation serves to strengthen the goods tray, enabling a thinner construction of the closed surface of the goods tray, which in turn enables still better thermal conductivity. At the same time, manufacture is less expensive, the weight the struts must support is reduced.

Assembly is simplified further and stability increased when the front and/or the rear fixing element has an upper side corresponding to the shape of the goods tray (particularly having the physical form of a fixing surface).

Particularly structurally advantageous is an embodiment of the merchandise display device in which the struts are each constructed as a single part and/or entirely from a single material, wherein the material is preferably steel. In this way, the struts may be embodied as slender steel strips or steel panels, wherein in particular the struts are positioned upright. This improves the supporting effect of the struts for the goods tray.

According to an advantageous embodiment of the present invention, the pusher device is advantageously furnished with a pusher element which has a pusher wall and two guide legs that clasp the sides of the goods tray. This simplifies the mounting of the pusher device on the goods tray, wherein the pusher device is guided in sliding manner along the goods tray. The system is thus suitable for long-term use even under extreme conditions. In particular, the guide legs are conformed on the pusher wall. It is further preferred if the guide legs extend orthogonal to the pusher wall or in the feed direction V.

In this context, an embodiment in which a latching element is arranged on the rear end, particularly in the corrugation, for engagement with the pusher device, particularly the pusher element is particularly suitable. The latching element may preferably have the form of a snap lock, in which the pusher element is snapped into place by pressure and disengaged therefrom by pressing again. This has the effect of considerably simplifying filling of the merchandise display device with items by an operator, without thereby limiting the space available for the goods.

It is further preferred if lighting elements that are actuated particularly by means of the latching element are arranged along and/or in the corrugation. The lighting elements may particularly be embodied as LED strips. This arrangement not only has the effect of improving the appearance of the merchandise display device, in particular it also makes the act of filling it easier.

According to an advantageous embodiment of the invention, the versatility of the merchandise display device is further improved if the divider wall has a front guide element and a rear guide element for guiding the divider wall, wherein the front guide element particularly extends through the front fixing element and the rear guide element particularly extends through the rear fixing element, in particular each extending transversely to the feed direction V.

In an advantageous further development of the invention, it is provided that the pusher device has two roller wheels on the goods tray, particularly on either side of the corrugation. This enables the pusher device to move much more easily, so that an actuating element, particularly a spring, does not have to be of such heavy construction and long-term operation is assured. Filling the merchandise display device is also made simpler. According to a particularly space-saving embodiment of the present invention, it is advantageously provided that the pusher device includes a roller spring which is particularly mounted in free suspension and rolls inside the corrugation.

Figure 1B:
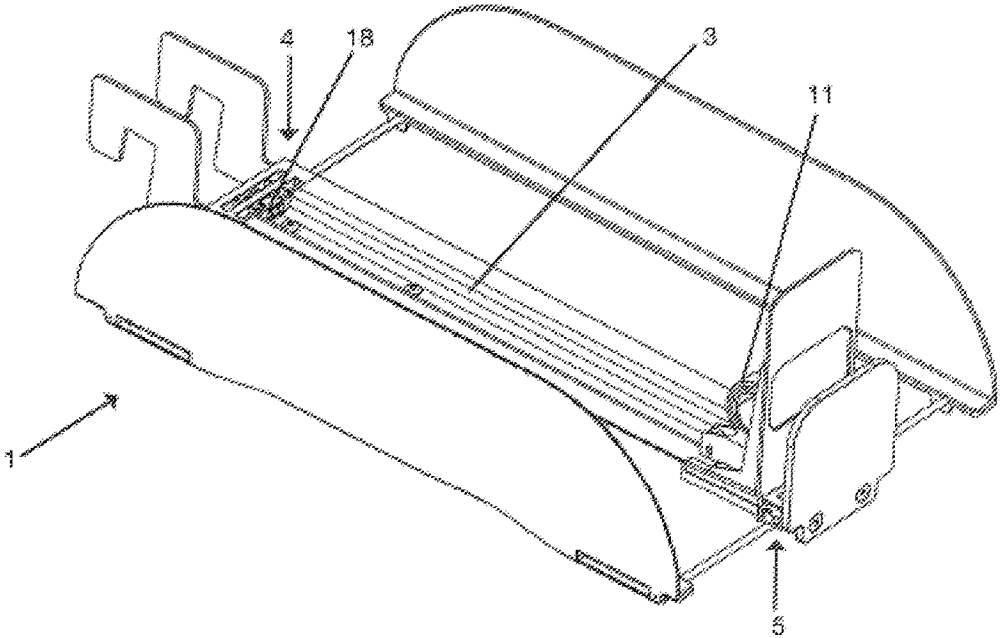
Figure 1C:
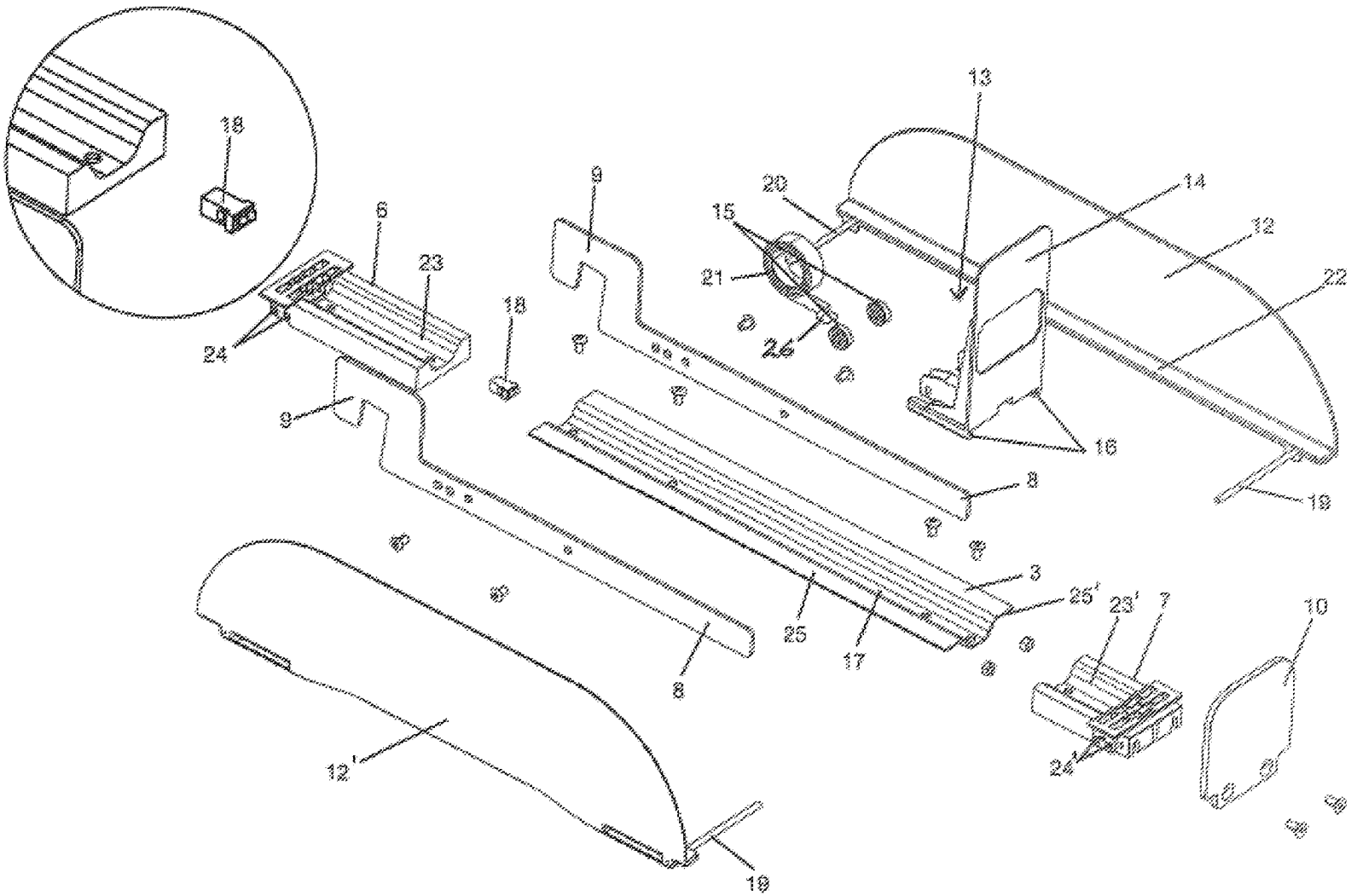

Further advantages, features and details of the invention will be apparent from the following description of preferred embodiments and with reference to the drawing. In the drawing:

FIG. 1*a*: shows an embodiment of the merchandise display device according to the invention with the divider walls in a fully in a fully retracted position, FIG. 1*b*: shows the embodiment of FIG. 1*a* with the divider walls in an extended position, and FIG. 1*c*: is an exploded view of the embodiment according to FIGS. 1*a* and 1*b*.

In the figures, components with the same or similar function are denoted with the same reference signs.

According to FIG. 1*c*, the merchandise display device 1 is assembled from the following elements:

A goods conveyor 2 consisting of an aluminum panel with a corrugation 17 is fastened, in this case screwed to a rear end 4 with a rear fixing element 6 and to a front end 5 with a front fixing element 7.

The fixing elements 6, 7 each have fixing surfaces 23, 23' for fixing the goods tray 3, the cross sections of which are shaped to correspond to the cross section of the goods tray 3. The fixing surfaces 23, 23' are each perforated by at least two screw holes, and the goods tray 3 has corresponding screw holes.

The fixing elements 6, 7 further have guide channels 24, 24', in particular arranged at the rear end 4 and the front end 5 respectively. The guide channels 24, 24' extend transversely to a feed direction V of the goods, in particular passing completely through the fixing elements 6, 7.

A goods end stop 10 is fixed, preferably screwed to the front fixing element 7. The goods end stop 10 is preferably embodied as a plate-like. particularly transparent element.

Struts 8 are fixed on each side of the rear fixing element 6 which is connected to the goods tray 3, and each has a hook section 9 on the rear end 4. The struts 8 are fastened, preferably clipped onto a corresponding bracket of a floating shelf by means of the hook sections 9.

Besides fixing the struts 8 to the rear fixing element 6, the struts 8 support the goods tray 3 with side wings 25, 25' of the goods tray 3 which bear at least partly, particularly mostly, preferably completely on the struts 8. The side wings 25, 25' preferably extend continuously over the entire length of the goods tray 3 on either side of the corrugation 17. At the same time, the side wings 25, 25' serve as bearing and sliding surfaces for the items lying on the goods tray 3.

The struts 8 are preferably formed as a single part and/or continuously from one material, preferably steel.

Before the front fixing element 7 or the rear fixing element 6 is fixed to the goods tray 3, a pusher element 13 of a pusher device 11 is connected to the goods tray 3. The connection is created by the pusher element 13 by guide legs 16 provided on an underside of the pusher element 13 which laterally clasp the wings 25, 25' of the goods tray 3. As soon as the fixing elements 6, 7 are fixed to the goods tray 3, it is preferably impossible to disconnect the pusher element 13 from the goods tray 3 non-destructively. However, the pusher element 13 can be slid along the goods tray 3 in the feed direction V and in the opposite direction to the feed direction V, wherein the guide legs 16 are guided in sliding manner along the side wings 25, 25'. The guide legs 16 are preferably conformed on a pusher wall 14 of the pusher element 13 and extend orthogonally to the pusher wall 14.

To improvement the movement of the pusher element 13, the pusher element 13 is equipped with two wheels 15, which may serve to guide the pusher element in addition to the guide legs 16. The wheels 15 preferably roll along the side wings 25, 25'.

The pusher device 11 is also equipped with a roller spring 21, which is held in place on the front fixing element 7 by an angled fixing end 26. The roller spring 21 is mounted in free suspension on a rear side of the pusher wall 14, particularly in a corresponding pocket. Accordingly, the pusher element 13 can only be displaced from the front end 5 to the rear end 4 against the spring force of the roller spring 21.

In order to simplify the operation of filling the merchandise display device 1 with goods, a latching element 18 is preferably arranged on the rear end 4, in which the pusher element 13 can be engaged. The latching element 18 preferably has the form of a pressure snap lock, so that the pusher element 13 may be snapped into place by pressure and disengaged by pressing again.

The roller spring 21 is preferably arranged so that the coiled area of the roller spring 21 rolls inside the corrugation 17.

Finally, divider walls 12, 12' are each displaced in the correspondingly extending and arranged guide channels 24, 24' by means of a front guide element 19 and a rear guide element 20. The guide elements 19, 20 of divider wall 12 are offset with respect to the guide channels 19, 20 of divider wall 12', so that the guide elements 19, 20 may be guided in different guide channels 24, 24'.

The divider walls 12, 12' further have an L-shaped bend 22, each of which is angled towards the goods tray 3, and of which the bend surface preferably extends from the rear end 4 to the front end 5. The bend 22 is preferably aligned with the side wings 25, 25' and together with the side wings 25, 25' forms a bearing surface and sliding surface for the goods.

LIST OF REFERENCE SIGNS

1 Merchandise display device
2 Goods conveyor
3 Goods tray
4 Rear end
5 Front end
6 Rear fixing element
7 Front fixing element
8 Struts
9 Hook section
10 Goods end stop
11 Pusher device
12, 12' Divider walls
13 Pusher element
14 Pusher wall
15 Wheels
16 Guide leg
17 Corrugation
18 Latching element
19 Front guide element
20 Rear guide element
21 Roller spring
22 L-shaped bend
23, 23' Fixing surfaces
24, 24' Guide channels

25, 25' Side wings
26 Fixing end
V Feed direction

The invention claimed is:

1. Merchandise display device (1) for displaying goods on a goods conveyor (2) with:

a goods tray (3) for supporting the goods along a feed direction (V) from a rear end (4) to a front end (5) of the goods tray (3), a rear fixing element (6) attached to the rear end (4), a front fixing element (7) attached to the front end (5), two struts (8) supporting the goods tray (3) on the rear fixing element (6), each of the struts having a hook section (9) for fastening the struts (8) to a bracket, a goods end stop (10) arranged on the front fixing element (7), a pusher device (11) which is guided along the goods tray (3) to advance the goods in feed direction (V), at least one divider wall (12, 12') which delimits the goods conveyor (2) laterally and is constructed to be displaceable for adjusting a width of the goods conveyor (2) transversely to the feed direction (V), wherein the goods tray (3) is constructed as a closed surface between the struts (8) such that when the rear fixing element (6) and the front fixing element (7) are respectively attached to the rear (4) and front ends (5) of the goods tray (3), the goods tray (3) has no openings therein apart from liquid drainage apertures, wherein further at least one of the front fixing element (7) or the rear fixing element (6) has an upper side that has a cross section corresponding to the shape of a cross-section of the goods tray (3).

2. Merchandise display device according to claim 1, wherein the goods tray (3) is made from rolled or extruded metal sheet.

3. Merchandise display device according to claim 1, wherein the goods tray (3) has at least one corrugation (17) extending continuously in the feed direction (V).

4. Merchandise display device according claim 1, wherein the struts (8) are each constructed as a single part and/or entirely from a single material.

5. Merchandise display device according to claim 1, wherein the pusher device (11) includes a pusher element (13) with a pusher wall (14) and two guide legs (16) which clasp the sides of the goods tray (3).

6. Merchandise display device according to claim 1, wherein a latching element (18) is arranged on the rear end (4), for engagement of the pusher device (11).

7. Merchandise display device according to claim 1, wherein the divider wall (12, 12') has a front guide element (19) and a rear guide element (20) for guiding the divider wall (12, 12') transversely to the feed direction (V), wherein the front guide element (19) extends through the front fixing element (7) and the rear guide element (20) extends through the rear fixing element (6).

8. Merchandise display device according to claim 1, wherein the pusher device (11) is equipped with two wheels (15) which roll on the goods tray (3).

9. Merchandise display device according claim 3, wherein the pusher device (11) is equipped with a roller spring (21) which rolls in the corrugation (17).

10. A merchandise display device (1) for displaying goods on a goods conveyor (2) with:

a goods tray (3) for supporting the goods along a feed direction (V) from a rear end (4) to a front end (5) of the goods tray (3);

a rear fixing element (6) attached to the rear end (4);

a front fixing element (7) attached to the front end (5);

two struts (8) supporting the goods tray (3) on the rear fixing element (6), each of the struts having a hook section (9) for fastening the struts (8) to a bracket;

a goods end stop (10) arranged on the front fixing element (7);

a pusher device (11) which is guided along the goods tray (3) to advance the goods in feed direction (V);

at least one divider wall (12, 12') which delimits the goods conveyor (2) laterally and is constructed to be displaceable for adjusting a width of the goods conveyor (2) transversely to the feed direction (V);

wherein the goods tray (3) is constructed as a closed surface between the struts (8) such that when the rear fixing element (6) and the front fixing element (7) are respectively attached to the rear (4) and front ends (5) of the goods tray (3), the goods tray (3) has no openings therein apart from liquid drainage apertures, and wherein the pusher device (11) includes a pusher element (13) with a pusher wall (14) and two guide legs (16) which clasp the sides of the goods tray (3).

11. The merchandise display device of claim 10 wherein at least one of the front fixing element (7) or the rear fixing element (6) has an upper side that has a cross section corresponding to the shape of a cross section of the goods tray (3).

12. The merchandise display device of claim 10, wherein the pusher device (11) is equipped with two wheels (15) which roll on the goods tray (3).

13. The merchandise display device of claim 10, wherein the divider wall (12, 12') has a front guide element (19) and a rear guide element (20) for guiding the divider wall (12, 12') transversely to the feed direction (V), wherein the front guide element (19) extends through the front fixing element (7) and the rear guide element (20) extends through the rear fixing element (6).

14. The merchandise display device of claim 10, wherein the goods tray (3) has at least one corrugation (17) extending continuously in the feed direction (V).

15. The merchandise display device of claim 14, wherein the pusher device (11) is equipped with a roller spring (21) which rolls in the corrugation (17).

16. A system comprising:

a goods tray (3) for supporting the goods along a feed direction (V) from a rear end (4) to a front end (5) of the goods tray (3);

a rear fixing element (6) attached to the rear end (4);

a front fixing element (7) attached to the front end (5);

two struts (8) supporting the goods tray (3) on the rear fixing element (6), each of the struts having a hook section (9) for fastening the struts (8) to a bracket;

a goods end stop (10) arranged on the front fixing element (7);

a pusher device (11) which is guided along the goods tray (3) to advance the goods in feed direction (V), wherein the pusher device (11) is equipped with two wheels (15) which roll on the goods tray (3);

at least one divider wall (12, 12') which delimits the goods conveyor (2) laterally and is constructed to be displaceable for adjusting a width of the goods conveyor (2) transversely to the feed direction (V), wherein the goods tray (3) is constructed as a closed surface between the struts (8) such that when the rear fixing element (6) and the front fixing element (7) are respectively attached to the rear (4) and front ends (5) of the goods tray (3), the goods tray (3) has no openings therein apart from liquid drainage apertures.

17. The system of claim 16 wherein at least one of the front fixing element (7) or the rear fixing element (6) has an upper side that has a cross section corresponding to the shape of a cross section of the goods tray (3).

18. The system of claim 16, wherein the pusher device (11) includes a pusher element (13) with a pusher wall (14) and two guide legs (16) which clasp the sides of the goods tray (3).

19. The system of claim 16, wherein the struts (8) are each constructed as a single part and/or entirely from a single material.

20. The system of claim 16, wherein the goods tray (3) is made from rolled or extruded metal sheet.

* * * * *